US006318804B1

(12) United States Patent
Brown

(10) Patent No.: US 6,318,804 B1
(45) Date of Patent: Nov. 20, 2001

(54) CHILD'S HAIR SHAMPOOING CHAIR

(76) Inventor: Linda Gale Brown, 1004 Varnedoe St., Hinesville, GA (US) 31313

( * ) Notice: Subject to any disclaimer, the term of this patent is extended or adjusted under 35 U.S.C. 154(b) by 0 days.

(21) Appl. No.: 09/628,965

(22) Filed: Jul. 31, 2000

Related U.S. Application Data

(60) Provisional application No. 60/155,895, filed on Sep. 27, 1999.

(51) Int. Cl.[7] ..... B60N 2/02

(52) U.S. Cl. ..... 297/354.13; 297/354.12; 297/17; 297/450.1

(58) Field of Search ..... 297/354.13, 19, 297/34, 219.12, 354.12, 378.1, 378.12, 452.24, 450.1, 17; 4/572.1, 573.1, 515, 516, 517, 519, 523, 659

(56) References Cited

U.S. PATENT DOCUMENTS

| | | | | |
|---|---|---|---|---|
| 2,697,480 | | 12/1954 | Du Bois . | |
| 2,947,350 | * | 8/1960 | Davis | 297/354.12 |
| 3,086,222 | * | 4/1963 | Hall et al. | 297/450.1 X |
| 4,167,048 | | 9/1979 | Williams . | |
| 4,240,662 | * | 12/1980 | Anderson | 297/17 |
| 4,527,830 | * | 7/1985 | Meyers | 297/17 X |
| 5,599,063 | * | 2/1997 | Lister et al. | 297/325 |

* cited by examiner

*Primary Examiner*—Laurie K. Cranmer

(57) ABSTRACT

The child's hair shampooing system is a chair designed to comfortably, conveniently, and safely accommodate babies, toddlers, and small children while washing and rinsing their hair, and to eliminate the chance of slipping. The child's hair shampooing chair protects the child's face, eyes and ears from water and suds while washing and rinsing the hair. The chair has an adjustable inserted neck rest (24A) to comfortably rest the child's neck and to allow water to freely flow away from the child's face, eyes and ears. The chair also has a replaceable cushioned lining (26) for the adjustable inserted neck rest, chair back, and body contoured seat for added comfort. The left and right arms (28L to 28R) prevent the child from falling out. A adjustment device (30), used while the child is seated to adjust inserted neck rest into desire reclining positions. The body contoured seat (34), drains water so that the child would not have to sit in soapy water from shampoo debris, which could sometime cause infection. A chair base (36), is used for stability when the chair is placed in the bathtub or on the countertop. After use, the Chair's Hair Shampooing Chair can be easily folded into a flat position (38) that can be stored, transported, or easily carried.

1 Claim, 6 Drawing Sheets

CHILD'S HAIR SHAMPOOING CHAIR

Under the provisions of 35 U.S.C. 1.19(e), priority is claimed from U.S. provisional patent application Ser. No. 60/155,895 filed Sep. 27, 1999.

BACKGROUND-FIELD OF INVENTION

This invention relates to a specially designed child's hair shampooing chair that safely, conveniently, and effectively shampoo babies, toddlers, and small children's hair.

BACKGROUND-DESCRIPTION OF PRIOR ART

The utility U.S. Pat. No. 5,599,063 to Lister, Lister, Feb. 4, 1997 is considered to be a very relevant prior art reference discovered during the search. This patent effectively discloses an invention which performs function similar to the function perform by the child's hair shampooing chair comprising the present invention. However, the structure of the invention shown in U.S. Pat. No. 5,599,063 is different from that of my invention, and I believe a patentable distinction could be made. The U.S. Pat. No. 5,599,063 reference also provides a good example of the amount of written and illustrated description required to obtain utility patent protection for my type of invention.

The utility U.S. Pat. No. 4,167,048 to Williams, Sep. 11, 1979 has been provided as another example of an invention which is related to the present invention and is relevant to the extent that a similar function is disclosed. Structural differences between my invention and the invention shown in the patent document U.S. Pat. No. 4,167,048 are evident however, this patent, either considered alone or in combination with the patent document U.S. Pat. No. 5,559,063 should not preclude the seeking of patent protection for the child's hair shampooing chair of the present invention. The U.S. Pat. No. 4,167,048 reference offer another good example of the amount of written and illustrated description required to obtain utility patent protection in the United States.

The U.S. Pat. No. 4,240,662, to Anderson, Dec. 23, 1980 which is another utility patent, is considered to be relevant to disclosed function of my invention. However, there are still structural differences between my invention, and the inventions disclosed in the patent documents U.S. Pat. Nos. 5,599,063; 4,167,048; and 4,240,662. Whether considered alone, or in combination with each other accordingly, these patent documents should not prevent me, in my opinion, from having a reasonably good chance of obtaining patent protection for my invention. The U.S. Pat. No. 4,240,662 reference provides another good example of the amount of written and illustrated description required to obtain utility patent protection.

U.S. Pat. No. 2,697,480 to Du Bois, Dec. 21, 1954 U.S. Pat. No. 3,086,222 to Hall and Jenkins, Apr. 23, 1963 and 266,940 to Roslan, Nov. 16, 1982 are provided as being of general interest and are also pertinent to the construction and design of my invention. They have been included with this report as being further indicative of the current state of the art.

Objects and Advantages

The main advantage of my invention, is the child will get a relaxing shampoo, the same as an adult get when they go to a beauty solon. Accordingly, there are several other objects and advantages of my invention, for example, the adjustable inserted neck rest which allows water to freely flow away from the child's face, eyes and ears. The adjustable inserted neck rest can be positioned in to any desired upright, inclined, or fully reclined positions while the child is seated. The child's hair shampooing chair has arms to prevent the child from falling out. The chair also has a special designed body contoured seat that drain water so that the child would not have to sit in soapy water and debris from shampoo which could sometime cause infection. The child's hair shampooing chair can be used after the hair is washed as a hair-grooming chair for the child.

The child's hair shampooing chair comes in bright vivid colors that are pleasing to a child's eyes.

The child's hair shampooing chair is lightweight, compact, and the adjustable inserted neck rest, can be folded flat to easily transport while traveling. The child's hair shampooing chair has a replaceable padded cushion for the adjustable inserted neck rest, chair back, and body contoured seat, for added comfort.

The old standard methods of having a child lean over the kitchen sink in an uncomfortable position, or sitting or standing in the unsafe bathtub, would be replaced by using my specially designed child's hair shampooing chair. The child's hair shampooing chair is also designed to eliminate the chance of slipping and to comfortably, conveniently, and safely accommodate babies, toddlers, and small children.

My child's hair shampooing chair would contribute to a more relaxing, pleasurable hair shampooing and grooming experience for babies, toddlers and small children. The child's hair shampooing chair is easy to use, practical, reasonably priced, and effective.

The child's hair shampooing chair would contribute to a more enjoyable hair shampoo, which makes doing a child's hair a pleasure, not a burden.

Further objects and advantages of my invention will become apparent from a consideration of the drawings and ensuing description.

DRAWING FIGURES

REFERENCE NUMERALS IN DRAWINGS

Figure 1:
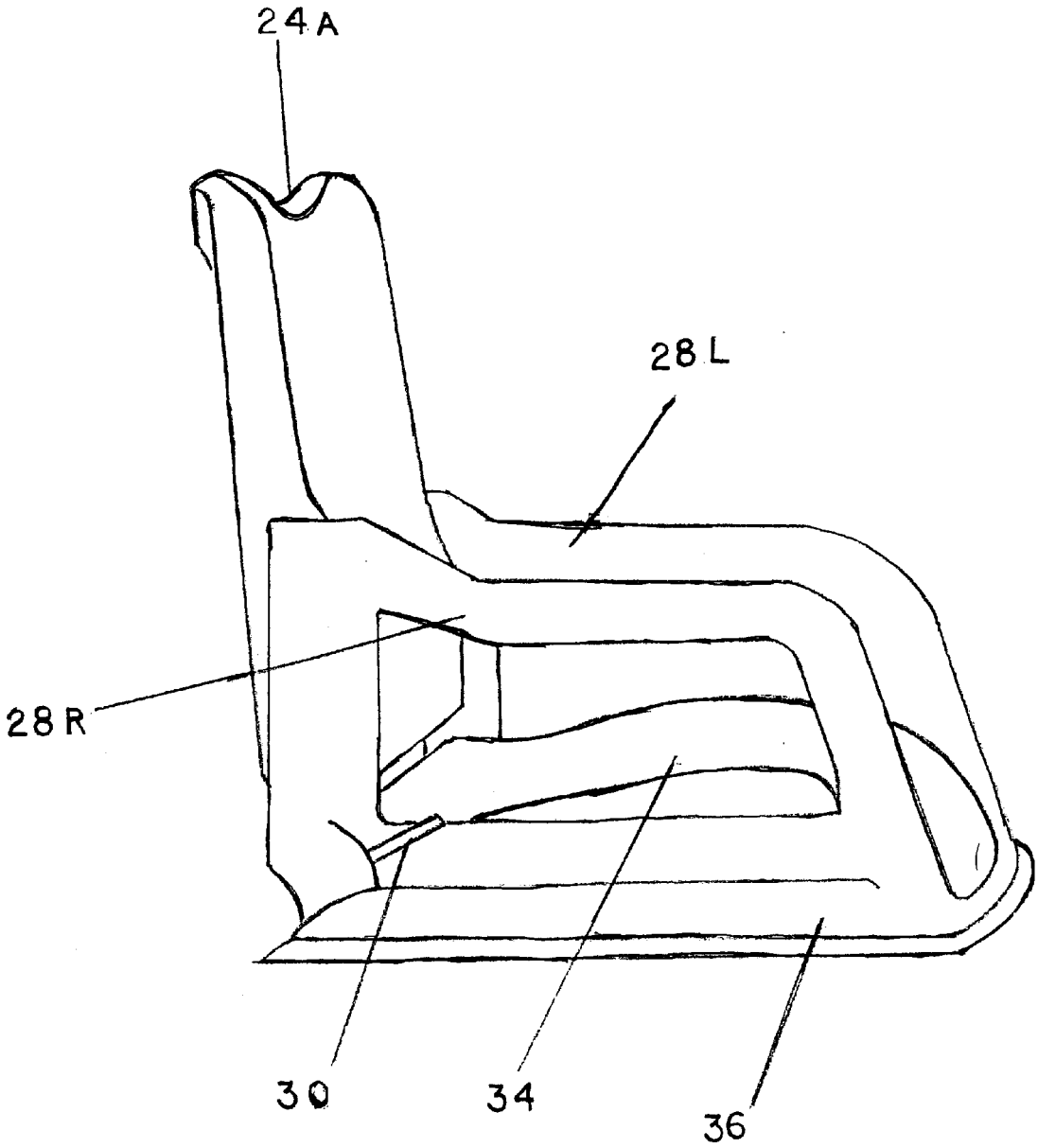
FIG. 1, Is a perspective view of the child's hair shampooing chair, in an upright position, the opposite side being a mirror of side shown.

24A adjustable inserted neck rest in upright position

24B adjustable inserted neck rest in inclined position

24C adjustable inserted neck rest in fully reclined position

26A–26C replaceable padded cushioned for adjustable inserted neck rest, chair back, and water draining body contoured seat

28L and 28R left and right arm rest

30 adjustment device to position inserted neck rest

32 Device to place inserted neck rest in folded position

34 water draining body contour seat

36 chair base

38 child's hair shampooing chair in folded position

SUMMARY

In accordance with the present invention, my specially designed child's hair shampooing system comprises a way to safely, conveniently, and effectively shampoo hair.

Description—FIGS. 1 to 6

The concept of the "CHILD'S HAIR SHAMPOOING CHAIR", is a specially designed chair that would protect a child's face, eyes and ears from water and suds while shampooing hair. The chair also has a special designed body contoured seat that drain water so that the child would not have to sit in soapy water and debris from shampoo which could sometime cause infection. Parents of babies, toddlers, and small children, if manufactured, could use this product.

Figure 2:
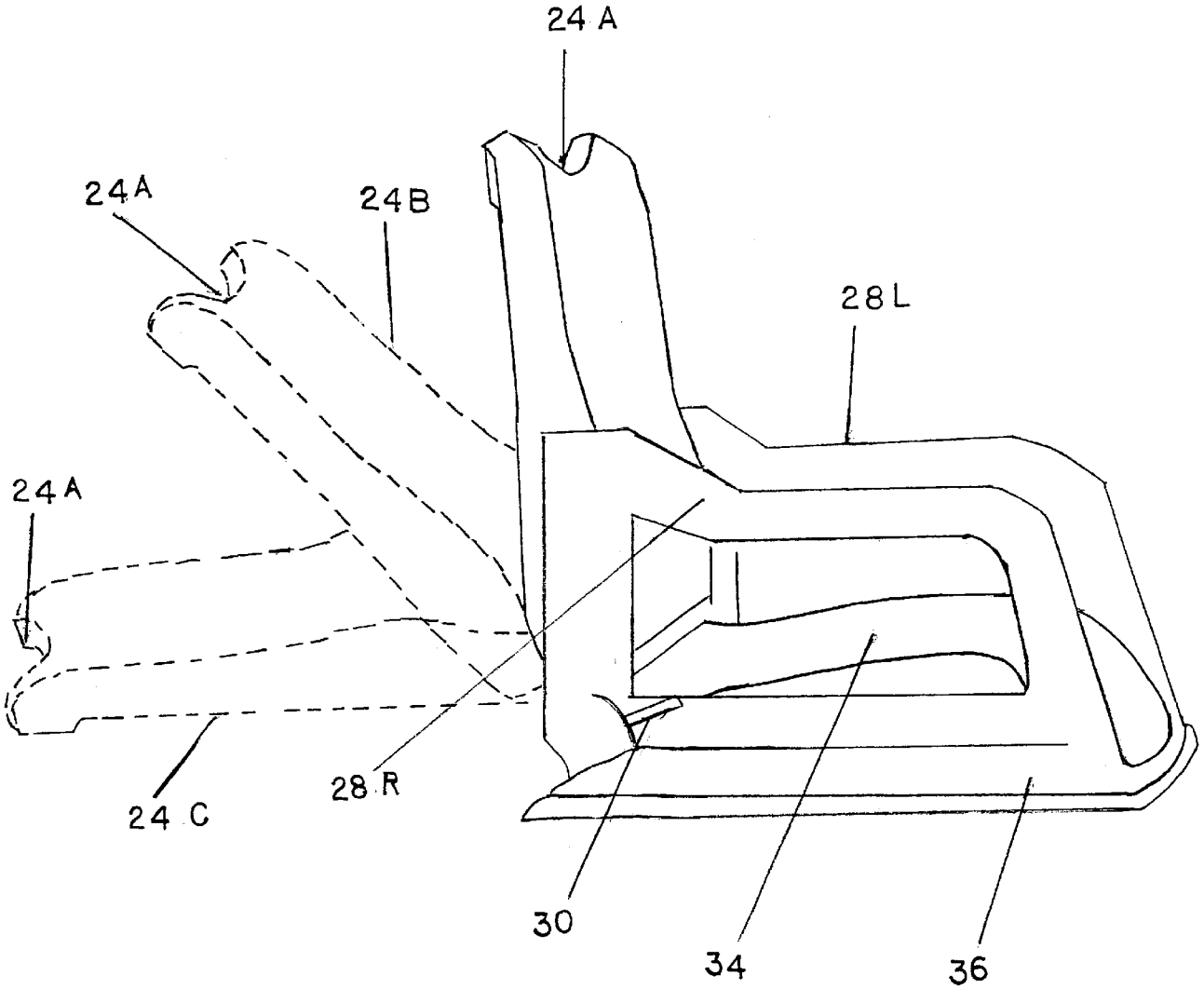
FIG. 2, Shows the adjustable inserted neck rest in the upright, inclined and fully reclined positions.
Figure 3:
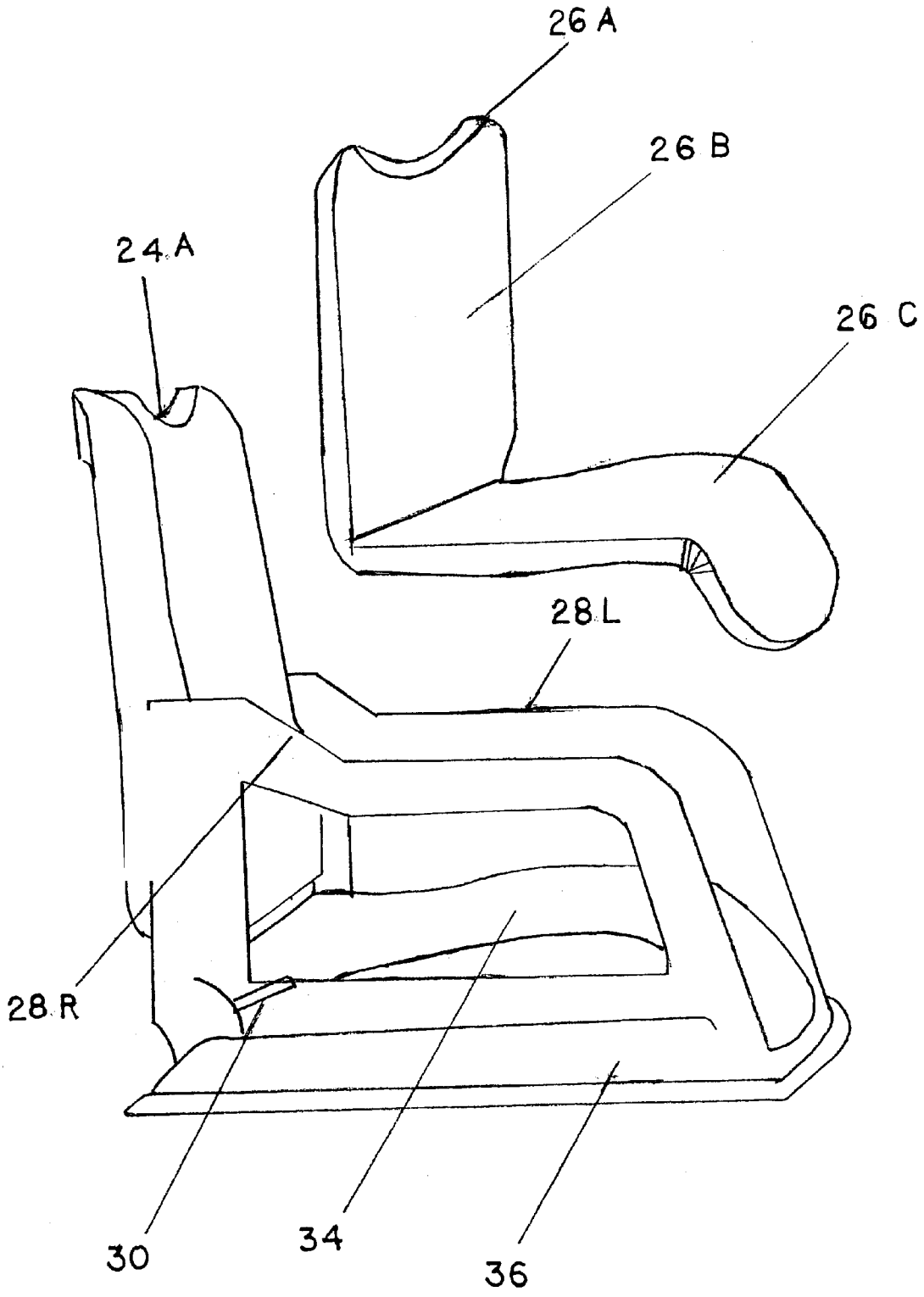
FIG. 3, Shows replaceable padded cushion for the inserted neck rest, chair back and water draining body contoured seat.
Figure 4:
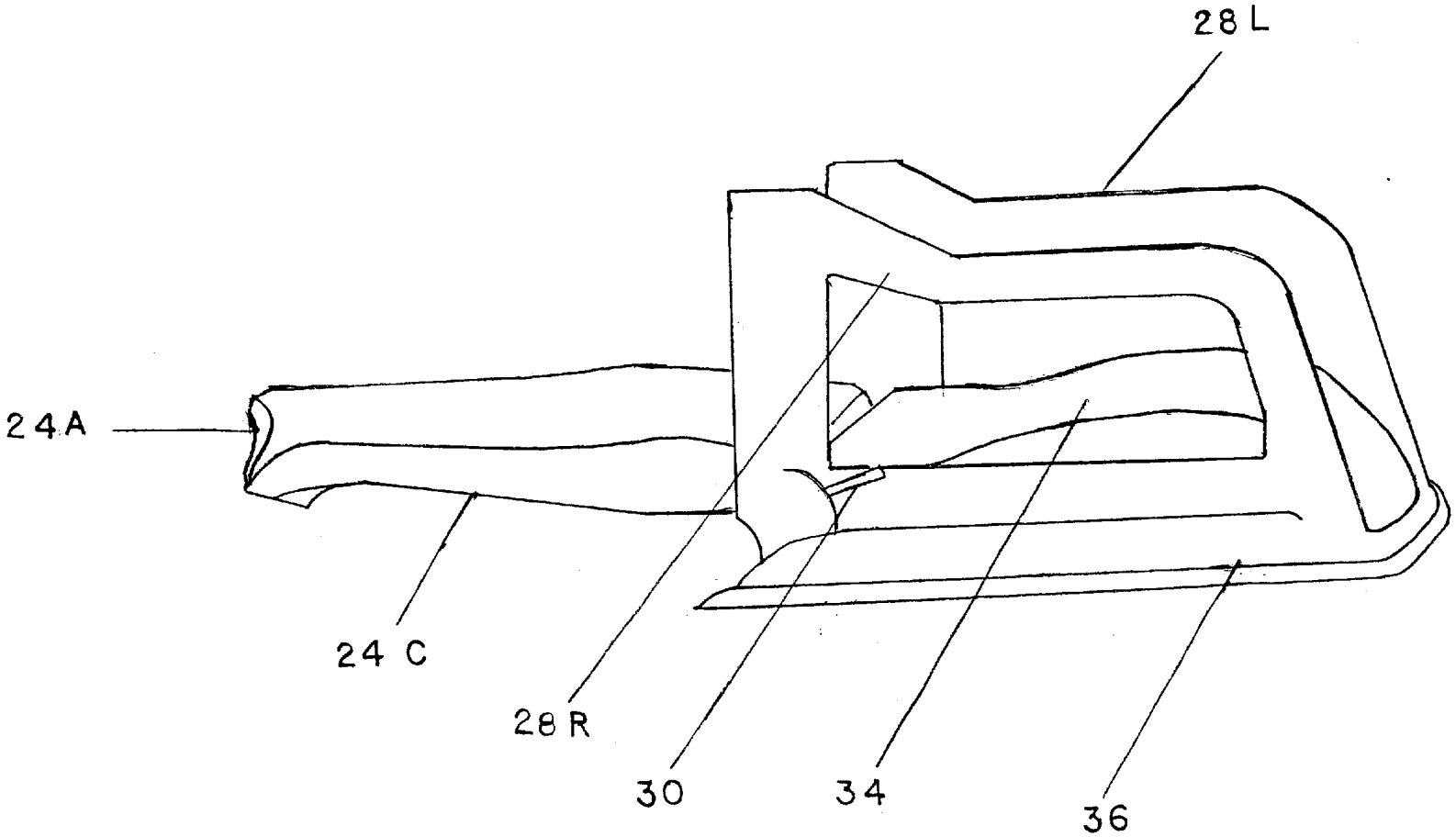
FIG. 4 Shows inserted neck rest in fully reclined position.
Figure 5:
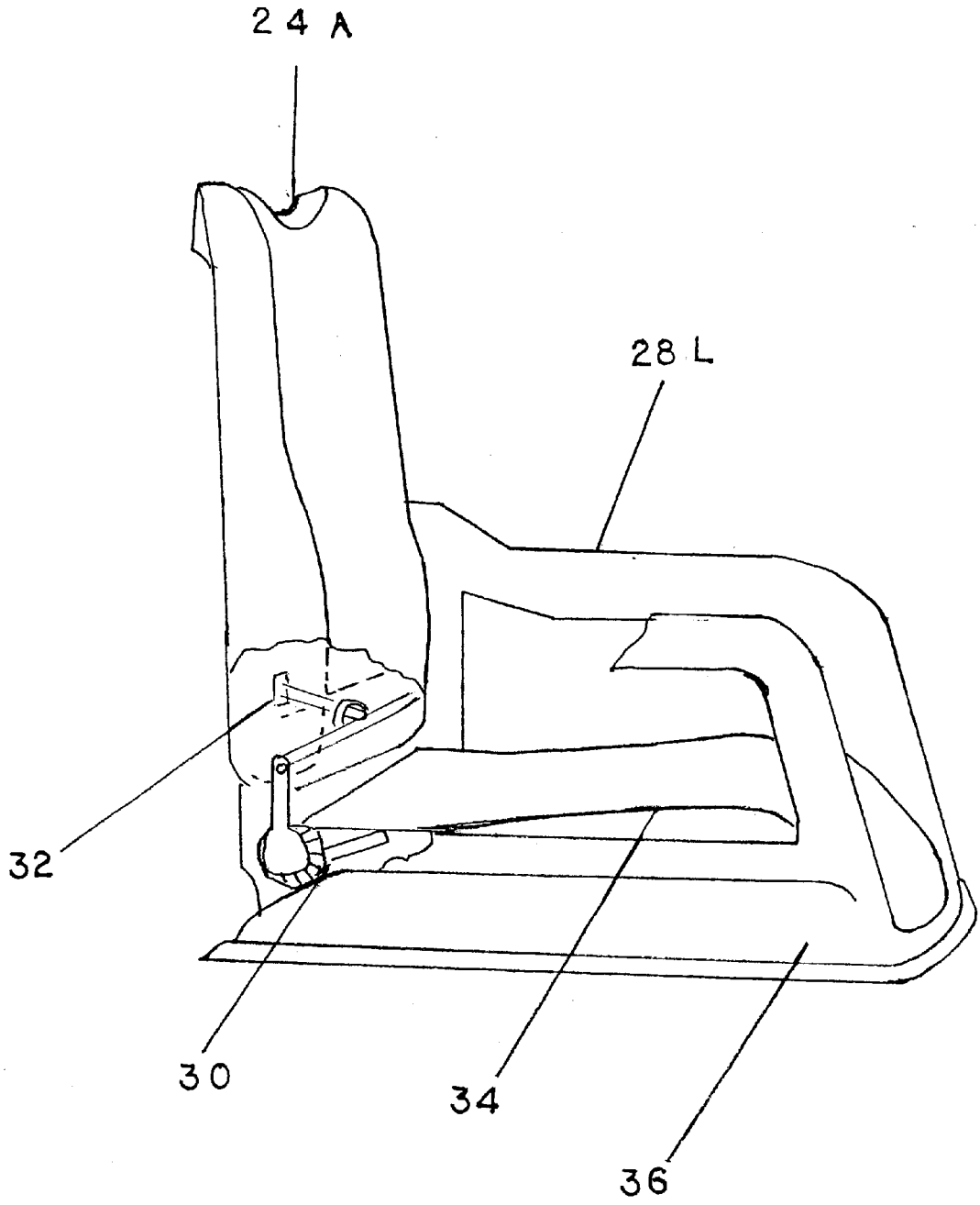
FIG. 5 Shows device used to adjust neck rest and device used to place inserted neck rest in folded position.
Figure 6:
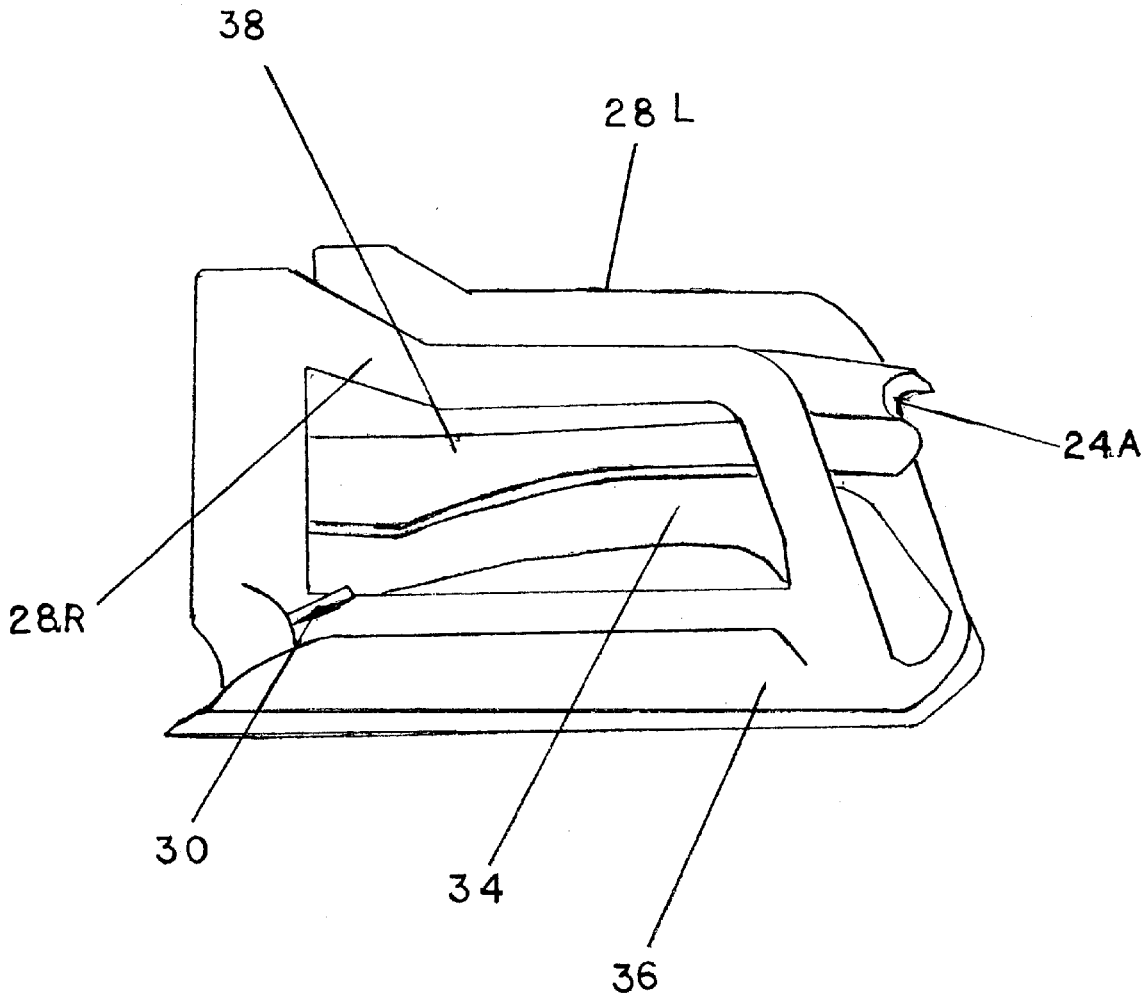
FIG. 6 Shows inserted neck rest folded position.

The Child's Hair Shampooing System (FIG. 1), would consist of a chair with an adjustable inserted neck rest 24A which could be placed into the upright, incline and fully recline positions 24A–24C, (FIG. 2). The chair has a replaceable padded cushion 26A–26C, (FIG. 3), used for added comfort to the adjustable inserted neck rest, chair back, and water draining body contoured seat. An adjustment device 30 (FIG. 5), for desired reclining positions for inserted neck rest. A device to position inserted neck rest in folded position 32 (FIG. 5), a water draining body-contoured seat 34 (FIG. 1), with chair base 36 (FIG. 1) for a secure stable fit in the bathtub or on a kitchen countertop. A parent would simply adjust the chair in to desired position while the child is seated. The "CHILD'S HAIR SHAMPOOING CHAIR" would provide a baby, toddler, or small child with a comfortable seat in which to rest while his/her hair is being washed. After use, this product could be easily folded for convenience 38 (FIG. 6) and stored, transported, or carried. This chair, which comes in a variety of sizes, could be produced from durable plastic, high density, non-absorbent form rubber or neoprene, and injection molding might be a standard approach to production. Comes in a wide variety of bright colors, styles, and sizes.

Operation—FIGS. 1–6

"CHILD'S HAIR SHAMPOOING CHAIR" would fulfil the need for a means of protecting a child's face, eyes and ears from water and shampoo while washing their hair.

The appealing features of "CHILD'S HAIR SHAMPOOING CHAIR" would be its safety, convenience, flexibility, novelty, durability, portability, lightweight, compact size, effectiveness, and ease of use. This specially designed chair would provide an efficient and safe system for shampooing and rinsing a small child's hair. The adjustable inserted neck rest would allow the water to freely flow away from child's face and into the bathtub or kitchen sink. With this product, a parent would have peace of mind knowing that water and shampoo would not enter his/her child's face, eyes, or ears while shampooing the hair. This chair would be appreciated in households with babies, toddlers, and small children. The chair base would provide stability, and the chair would allow parents to shampoo their child's hair with ease and minimal effort. The water draining body contoured seat would prevent possible infections because the child would not have to sit in soapy water and debris from shampoo. This could contribute to a more pleasurable hair shampooing experience while in the bathtub. In addition, the child would be seated in an inclined or fully reclined position, which could contribute to a more enjoyable relaxing hair shampoo. The "Child's Hair Shampooing Chair" would be timesaving, effective, practical, waterproof, safe, and reasonably priced. In addition, its lightweight and compact designed would allow the chair to be easily folded, stored, and transported while traveling.

Conclusion, Ramification, and Scope

While my above description contains many specifications, these should not be construed as limitations on the scope of my invention, but rather as an illustration of one preferred embodiment thereof. Many other variations are possible. For example, the potential exists for varying production of "CHILD'S HAIR SHAMPOOING CHAIR" in ways, which could make it more appealing to a wider range of users. This could include producing the CHILD'S HAIR SHAMPOOING CHAIR" of various sizes.

As one variation, the "CHILD'S HAIR SHAMPOOING CHAIR" could be incorporated into the design of a bathtub for babies. Another would be to make the Child's Hair Shampooing Chair on a larger scale to accommodate adults who can not stand in the shower to wash their hair or can not go out to a beauty salon. They can get their hair shampoo and groomed in the comfort of their own home, just by setting the chair inside of the bathtub or on the side of the bathtub in the inclined or fully reclined positions. Hospitals can also utilize this hair shampooing system for Ill people.

Accordingly, the scope of my invention should be determined not by the embodiments illustrated, but by the appended claims and their legal equivalents, rather than by the examples given.

What is claimed is:

1. A chair for shampooing hair, having a seat associated with a back wherein said back is foldable downward overlying said seat for compact storage and transporting, said back including a semicircular opening at the top to stabilize and support the neck of an occupant, said semi circular opening being defined by a radius according to chair size, said back pivoting into at least three different angles of reclination, a spring loaded bar with ends in opposed notches for retaining said chair back in various angles of reclination once released, comprising a body contoured seat with voids for means of water drainage, said seat having side arms, and a base for stability on a surface, said seat having a bar associated with a control lever located at a rear side of said seat wherein said bar disengages from a groove located on lower back of said chair for folding of said chair back downward overlying said seat, a replaceable padded cushion lining made of durable plastic for the semicircular opening for the neck support, chair back, and body contoured seat.

* * * * *